United States Patent [19]

Urani

[11] Patent Number: 4,496,929

[45] Date of Patent: Jan. 29, 1985

[54] LOW CURRENT INDICATING FUSE

[75] Inventor: Angelo Urani, St. Louis, Mo.

[73] Assignee: McGraw-Edison Company, Rolling Meadows, Ill.

[21] Appl. No.: 483,908

[22] Filed: Apr. 11, 1983

[51] Int. Cl.[3] ..... H01H 85/30; H01H 85/16

[52] U.S. Cl. ..... 337/265; 337/261

[58] Field of Search ..... 337/265, 267, 268, 270, 337/262, 261, 260, 241, 244, 187; 200/159 A

[56] References Cited

U.S. PATENT DOCUMENTS

| | | | |
|---|---|---|---|
| 3,190,987 | 6/1965 | Fister | 337/265 |
| 3,538,480 | 11/1970 | Urani | 337/187 |
| 3,870,840 | 3/1975 | Rivetta et al. | 200/159 A |

*Primary Examiner*—Harold Broome

*Attorney, Agent, or Firm*—Charles W. MacKinnon; John S. Paniaguas; Jon Carl Gealow

[57] ABSTRACT

An indicating fuse is provided with an indicator at the free end of a movable spring contact, the indicator being located at an angle with respect to the plane of the spring contact. Provision is made for lower rated fusing currents utilizing the same basic fuse structure by forming a slot in the flexible spring contact at the point of maximum bending. A rounded shoulder is formed on the fuse carrier body across which the spring contact member is bent to minimize breakage and damage. The flexible spring contact is integrally formed with a U-shaped terminal that mounts it on the fuse carrier body, a second substantially identical generally U-shaped terminal also being secured to the fuse carrier body to provide a fixed contact. Molded ribs are formed in the insulating material of the fuse carrier body adjacent the open ends of the U-shaped terminal members to prevent the terminals from pinching together to form an undesired tapered configuration.

5 Claims, 6 Drawing Figures

LOW CURRENT INDICATING FUSE

BACKGROUND OF THE INVENTION

This invention relates generally to the type of fuse that provides a visual indication when fusing occurs, and more specifically, this invention relates to the type of fuse that closes an alarm circuit when fusing occurs, while also providing a visual indication that the fuse has cleared.

In the present invention, a fuse is utilized in which a resilient or flexible spring contact is held in a flexed position by an electrically conducting fusible link connected between the spring contact and a stationary terminal. Upon melting or fusing of the fusible link, the resilient spring contact moves to engage a contact on another terminal within the fuse holder to complete an alarm circuit. An indicating device is carried on the end of the flexible spring contact to provide a visual indication that the fuse has cleared. A fuse of this type is disclosed in U.S. Pat. No. 3,190,987—Fister, issued on June 22, 1965 for "Protectors for Electric Circuit" and assigned to the same assignee as the present application.

Fuses of the type to which the present invention is directed are frequently employed in situations where a relatively large number of fuses are mounted in close proximity. In such an arrangement, provision of the visual indicator is particularly important, as it permits an operator to readily ascertain which of the fuses has cleared. An arrangement for mounting a multiplicity of such indicating fuses is disclosed in U.S. Pat. No. 3,538,480—Urani, issued on Nov. 3, 1970 for "Protectors for Electric Circuits" and assigned to the same assignee as the present application.

While these prior art indicating fuses have been used quite successfully, there are factors that have prevented optimum utilization of these indicating fuses. Thus, for example, the present indicating fuses may be utilized for a range of actuating or fusing currents, depending upon the size of the fusible link employed. However, there are situations in which it would be desirable to be able to obtain actuation of the fuse at very low current levels.

With present indicating fuses, there is a minimum level of fusing current imposed by the physical structure of the fuse because the flexible spring element provides a certain return spring force, depending upon the dimensions and material of the flexible spring contact, when it is flexed into the normal conducting position where it is held by the fusible link. However, if the size of the fusible link is decreased to too great an extent (i.e., constructed to sense and fuse in the presence of a very low current), the fusible link will be too limited in mechanical strength to be able to maintain the flexible contact in the flexed position. It is possible to overcome this problem by varying the size of the flexible spring contact, but it is highly desirable to be able to achieve sensitivity to a very low fusing current without modifying the basic structure of the indicating fuse.

Another potential problem involves the engagement between the spring contact terminal and the stationary terminal, on the one hand, and their corresponding terminal clips on the fuse holder with which they must provide a continuous electrical current path, on the other hand. Both the spring contact terminal and the stationary terminal are wrapped on extended ear portions of the insulating body of the fuse carrier, thereby taking on a generally closed U-shape. The terminal clips on the fuse holder have flexible members which forcibly engage the U-shaped terminals, as illustrated in FIGS. 11 and 12 of the above-identified Fister patent.

The generally U-shaped terminals have inwardly projecting flanges at the open ends of the U-shaped members, with the ends of the flanges having a gap of a predetermined width therebetween. This gap width is set such that the flanges can secure the generally U-shaped terminals in position. In order to give the necessary strength, and yet provide sufficient resiliency to permit the terminals to be placed on the insulating body during manufacture, the terminals are currently formed with a dimension across the bottom of the "U" which is somewhat greater than the corresponding dimension of the portion of the insulating body on which it is fitted. The result is that the legs of the U-shaped terminal and flanges pinch toward one another and the terminal ends up with a tapered configuration.

This tapered configuration is essentially only a problem upon engagement with the spring members of the corresponding terminal clips. As a result of the tapered configuration of the terminals, the spring portions of the terminal clips provide a force component that tends to drive the terminals out of engagement with the spring portions of the terminal clips. Accordingly, if the fuse is jostled or jiggled, the electrical engagement between the terminals and the terminal clips may be broken.

Also, the tapered structure of the terminals can result in less area of engagement between the spring portions of the terminal clips and the tapered U-shaped terminal itself. The smaller contacting area that results is also a potential source of problems. Therefore, it would be desirable to have the generally U-shaped terminals maintain the legs of the "U" in parallel rather than tapering toward the open end.

Another area for improvement is in connection with the visual indicator. Normally, the indicator is just placed on the end of the flexible spring contact, with its axis aligned with the axis of the spring contact. Although this indicator does suffice for visual observation, it is frequently difficult to observe it as readily as might be desired. Accordingly, it would be desirable to have the indicator more visible.

SUMMARY OF THE INVENTION

With the present invention, an indicating fuse is provided that overcomes the deficiencies noted in prior art idicating fuses, as well as providing a number of other desirable features.

In the fuse of this invention, a fuse holder formed of insulating material is provided for mounting the indicating fuse on an appropriate support, such as that shown in the above-identified Urani patent. This fuse holder has three terminals secured therein. A first terminal clip is attached at one end of the fuse holder and is adapted to engage and provide electrical continuity with the stationary terminal, while a second terminal clip is adapted to engage and provide electrical continuity with the spring contact terminal to which the flexible spring contact is attached. A third terminal is attached at the second end of the fuse holder and has a projecting member forming a contact to engage the flexible spring contact when the fuse has cleared. The spring contact terminal and the stationary terminal are mounted on the fuse carrier which has a body formed of an insulating material, such as bakelite. Two projecting ears on the fuse carrier body are adapted to have the generally U-shaped terminal secured thereto. Attached to one generally U-shaped terminal is one end of the elongated flexible spring contact, which is preferably integrally formed with the U-shaped terminal. Molded ridges or ribs are located on the fuse carrier body adjacent the open end of the U-shaped terminal member to prevent the terminal from pinching together at the open end thereby to avoid the undesired tapered configuration. In this fashion, the legs of the generally U-shaped terminal are maintained substantially parallel, without interfering with the security of the attachment of the terminal to the carrier body and without interfering with the installation of the terminal onto the body. Thus, the potential problems inherent in the tapered configuration that results from the pinching together of the open end of the terminal members may be obviated, without a major modification of the present structure of the fuse and without loss of the desirable characteristics of the generally U-shaped terminals currently in use.

The second generally U-shaped terminal is placed upon the other projecting ear of the fuse carrier body opposite the U-shaped terminal of the flexible spring contact. This second U-shaped terminal provides the stationary terminal which is connected to the flexible spring contact through the fusible link. When the fuse is placed in a circuit to be protected, the resilient spring contact is flexed toward the stationary terminal and is held in that position by the fusible link. When the fusible link is melted or fused by an overload current, the spring contact will move from the flexed position to engage the contact on the third terminal in the fuse holder to close an alarm circuit.

A colored indicator tube is located on the free end of the flexible spring contact. When the fusible link is still intact and the spring contact is in the flexed position, the indicator is somewhat concealed behind an extending shoulder formed on the end of the fuse carrier body away from the oppositely projecting ears. When the fusible link is broken by an excessive current, the indicator is allowed to move from behind the concealing shoulder to permit visual observation that the fuse has cleared.

In order to make the indicator more readily visible, in the fuse of this invention a portion or section of the spring contact at the free end thereof is formed at an angle with respect to the plane of an adjacent portion of the spring contact. The indicator tube is mounted on this section or portion of the flexible spring contact. Therefore, not only is the indicator moved from behind the blocking shoulder upon fuse operation, but as the indicator moves through an arc from its normal position when the spring contact is flexed to the point where the spring contact closes the alarm circuit, the angle of the indicator is altered to make the comparison with unactuated elements even move readily apparent upon visual observation.

With this basic structure, fuses can be constructed having a range of ratings (maximum or fusing currents) by varying the size of the fusible link. In order to increase the range of fuse capacities on the lower end (i.e., elements that will fuse at lower maximum currents), a slot is formed in the flexible spring at the point where its maximum bending occurs, near the generally U-shaped terminal. The weakening the return spring force to the flexible contact permits the use of a smaller fusible element, thus providing for fusing at lower maximum currents. This slot may take any desired shape, although a generally rectangular slot is preferred. Also, the size of the slot may be varied to permit some adjustment of the lowest fusing current that may be reached. The exact size and shape utilized would depend upon a balancing of the smallest fusible link desired and the amount of spring force needed to cause the spring contact to close the alarm circuit. This approach permits the realization of fuses that may be actuated at lower fusing currents, without changing the shape or structure of the standard fuse.

In order to minimize damage to the flexible spring contact, especially when the weakening slot is utilized, a rounded shoulder should be located on the body immediately under the area of maximum bending of the flexible spring contact. This rounded shoulder minimizes damage to the spring contact that may occur when a square or flat shoulder is utilized.

These and other objects, advantages and features of this invention will hereinafter appear, and for purposes of illustration, but not of limitation, an exemplary embodiment of the subject invention is shown in the appended drawing.

DETAILED DESCRIPTION OF THE PREFERRED EMBODIMENT

Figure 1:
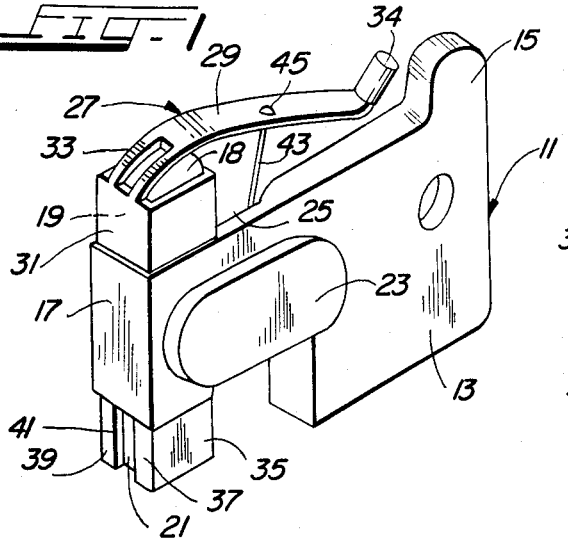
FIG. 1 is a perspective view of a fuse carrier constructed in accordance with the present invention.

A fuse carrier 11 is illustrated in FIGS. 1–4. Fuse carrier 11 has a body member 13 formed of a suitable insulating material, such as bakelite. Body member 13 is formed with an extending shoulder 15 at one end thereof. At the other end of body member 13 there is a bottom portion 17 having projecting ears 19 and 21. A protruding ridge 23 is formed on the side of body 13 to provide a keying member to ensure that fuse carrier 11 is properly inserted into a corresponding fuse holder.

Figure 4:
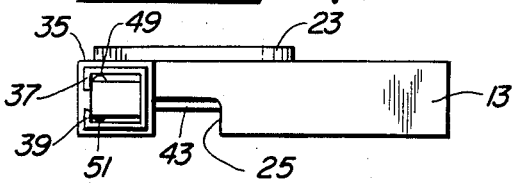
FIG. 4 is a side plan view of the fuse carrier of FIG. 1.

A recess 25, best seen in FIG. 4, is formed along one side of the spring member 13. A fusible link passes through this recess, as explained in more detail below.

On one side of fuse carrier 11 there is located an alarm actuating elongated flexible spring contact 27. Flexible spring contact 27 has a spring portion 29 that is mounted on body 13 by a generally U-shaped terminal 31. One end of spring portion 29 is affixed to the U-shaped terminal 31 in any suitable manner, but in this preferred embodiment the body portion 29 and the U-shaped terminal 31 are integrally formed. The advantages of such a one piece or integral formation is the elimination of potential problems with a solder connection, the providing of better conductivity and an increase in the potential for automating assembly of the fuse.

Figure 2:
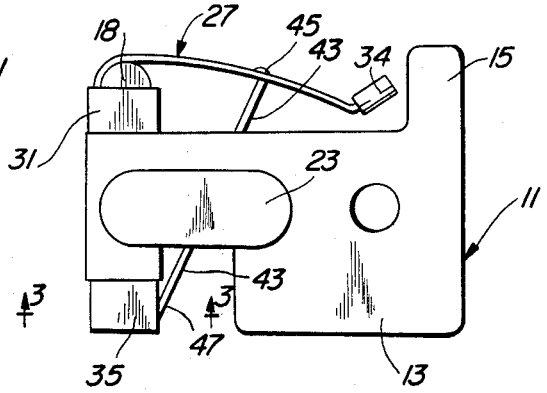
FIG. 2 is a side-elevational view of the fuse carrier of FIG. 1.
Figure 3:
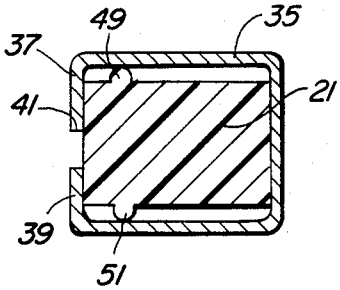
FIG. 3 is a cross-sectional view taken along line 3—3 of FIG. 2.
Figure 5:
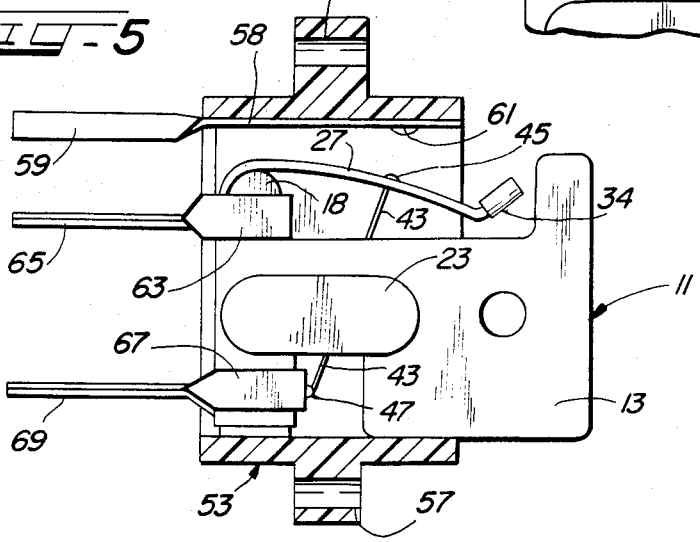
FIG. 5 is a side-elevational view of the fuse carrier of FIG. 1 located in a fuse holder.

During operation of the fuse in a conducting circuit, the spring portion 29 of spring contact 27 is flexed to the position shown in FIGS. 1, 2 and 5. The maximum bending of portion 29 when spring contact 27 is in this flexed position occurs adjacent generally U-shaped terminal 31. A rounded shoulder 18 is formed on ear 19 where this maximum bending occurs to minimize the potential for breaking spring portion 29 in the case where it is forcibly bent over ear 19. In order to utilize this type of fuse at lower rated fusing currents, a generaly rectangular slot 33 is formed on spring contact 27 at the point of maximum bending adjacent U-shaped terminal 31. The shape and size of the slot 33 may be altered to provide desired characteristics, the primary such characteristic being the weakening of the return spring force exerted by spring contact 27 in the flexed position shown. By weakening this spring force, a smaller fusible link may be utilized to provide a lower rated fuse in which melting or fusing of the fusible link occurs at a lower maximum current level.

Figure 6:
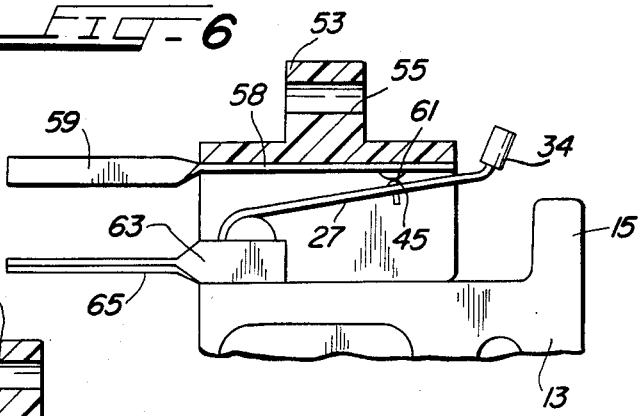
FIG. 6 is a portion of the side-elevational view of FIG. 5 illustrating the position of the flexible spring contact after the fuse has cleared.

At the free end of spring portion 29 of flexible spring contact 27, there is located an indicator 34. Indicator 34 may be any suitable type of indicating device, such as a cylindrical member placed over a portion or section of spring contact 27 at the free end thereof. In order to increase the visibility of this indicator, it is desirable to form spring contact 27 with a portion at the free end thereof bent at an angle to the plane of an adjacent portion of spring contact 27. In this way, the indicator 34 sticks out from spring contact 27 and hence is more easily observed. Also, as spring contact 27 moves from the flexed position shown in FIGS. 1, 2 and 5 to the unflexed position of FIG. 6, when the fuse has cleared, the angle of indicator 34 with respect to the fuse carrier body 13 is altered, so that in comparison with other fuses which have not cleared, it is readily apparent which fuse must be replaced. This is true even through indicator 34 is normally relatively concealed behind shoulder 15 when it is in the flexed position.

A stationary contact is provided by another generally U-shaped terminal 35. Terminal 35 is substantially identical to the U-shaped terminal 31 that supports spring contact 27 on body 13. Accordingly, the description of U-shaped terminal 35 may also be applied to terminal 31.

Terminal 35 has a pair of flanges 37 and 39 located at the open end of the "U". Flanges 37 and 39 extend inwardly toward one another for a given distance to produce a predetermined gap 41 therebetween. Flanges 37 and 39 serve to keep U-shaped terminal 35 from being separated from ear 21, once the terminal is placed in position. Terminal 35 is formed of an electrically conducting material that has some resiliency and flanges 37 and 39 which are short enough to permit them to be spread far enough apart for attaching stationary terminal 35 to ear 21. This resiliency also helps to secure terminals 31 and 35 to ears 19 and 21, respectively.

A fusible link 43 is secured to spring contact 27 at one end thereof in any appropriate fashion, such as by soldering to produce the lump of solder 45. When the fuse is ready for installation in a circuit to be protected, spring contact 27 is flexed and the other end of fusible link 43 is fastened to stationary terminal 35, such as by solder connection 47. In this condition, fusible link 43 extends from spring terminal 27 to stationary terminal 35 through the recess 25.

As explained above, the widened closed end and resiliency of terminals 31 and 35 tends to cause the open end of the "U" (i.e., the ends of flanges 37 and 39) to pinch together to form a tapered form or configuration. In order to prevent this tapering, with the attendant disadvantages pointed out above, ribs or ridges 49 and 51 are molded or otherwise formed on the sides of ears 19 and 21 relatively close to the open end of the "U". The ribs or ridges may generally be formed from the same insulating material as the rest of body 13 and extend along the length of the ears 19 and 21. These ribs or ridges keep flanges 37 and 39 spaced with the predetermined gap 41 so that the legs of the U-shaped terminals are maintained substantially parallel to improve the electrical contact with terminal clips of the fuse holder.

Such a fuse holder 53 is illustrated in FIG. 5. Fuse holder 53 has appropriate openings 55 and 57 throught which appropriate screws or bolts may be placed to secure it to a suitable support. Such a support is shown and discussed in the Urani patent identified above.

A first holder terminal 58 is secured at one end of fuse holder 53. Terminal 58 has an extending blade 59 which may be attached to any appropriate electrical circuit. In this case, the terminal would be connected to one side of an alarm to be actuated open the clearing of fuse element 43. A projecting member or contact 61 is formed on terminal 57 to close the alarm circuit by engaging the projecting solder lump 45 of fusible element 43 on spring contact 27 when the fuse opens.

A first terminal clip 63 is secured in fuse holder 53 to engage fuse terminal 31 of spring contact 27. Terminal clip 63 is provided with spring members to engage fuse terminal 31, as best illustrated in FIGS. 11 and 12 of the above-identified Fister patent. A blade or portion 65 extends outwardly from terminal clip 63 to make connection to any desired electrical circuit.

A second terminal clip 67 is secured in the end of fuse holder 53 opposite holder terminal 58. Terminal clip 67 has the same type of spring arrangement as terminal clip 63 in order to engage the U-shaped contact that forms stationary terminal 35. Terminal clip 67 is also provided with a blade or connector 69 for connection to any suitable electrical circuit. By inserting the fuse carrier 11 in the fuse holder 53, as illustrated in FIG. 5, the indicating fuse structure is completed with the various advantages set forth above.

It should be understood that various modifications, changes and variations may be made in the arrangement, operation and details of construction of the elements disclosed herein without departing from the spirit and scope of this invention.

I claim:

1. An indicating fuse assembly comprising:

a fuse holder;

a first holder terminal secured in said fuse holder;

a fuse carrier mounted in said fuse holder, said fuse carrier having a body member formed of insulating material;

said fuse carrier body including first and second projecting ears;

said first projecting ear having a rounded shoulder formed at the end thereof;

an alarm actuating elongated flexible spring contact, a first end of said spring contact mounted on said first projecting ear;

an indicator mounted on the free end of said spring contact;

a slot formed in said spring contact adjacent said first end thereof to reduce the return spring force exerted by said spring contact when flexed, said slot in said spring contact being generally rectangular in shape;

a first terminal clip secured in said fuse holder to electrically connect with said flexible spring contact the electrical connection between said flexible spring contact and said first terminal clip being made through a resilient generally U-shaped conducting terminal secured to said first projecting ear;

a fixed contact terminal mounted on said second projecting ear and spaced from said spring contact;

a second terminal clip secured in said fuse holder to electrically connect with said fixed contact terminal;

a fusible link extending from said flexible spring contact to said fixed contact terminal to hold said spring contact in a flexed position and providing a conducting path from said fixed contact terminal to said spring contact, the fusing of said fuse link releasing said spring contact to engage said first holder terminal to actuate an alarm and position said indicator for visual observation;

said spring contact passing over said rounded shoulder formed on said first projecting ear to thereby minimize breaking of said spring contact in the event that it is forceably bent over said shoulder; and said flexible spring contact and said conducting terminal being integrally formed.

2. An indicating fuse as claimed in claim 1 wherein said free end of said spring contact on which said indicator is mounted is formed at an angle to the plane of an adjacent portion of said spring contact.

3. An indicating fuse as claimed in claim 1 wherein:

said fixed contact is a second resilient generally U-shaped conducting terminal secured to a second projecting ear of said fuse carrier body member.

4. An indicating fuse as claimed in claim 1 wherein each of said projecting ears are formed with a pair of molded ribs adjacent the open end of the respective terminal to maintain the legs of said terminals substantially parallel, thereby preventing the open ends of said terminals from pinching together and forming a tapered configuration.

5. An indicating fuse comprising:

a fuse holder;

a first holder terminal secured in said fuse holder;

a fuse carrier mounted in said fuse holder, said fuse carrier having a body member formed of insulating material;

a first projecting ear formed on said fuse carrier body member;

an alarm actuating elongated flexible spring contact;

a first resilient generally U-shaped conducting fuse terminal integrally formed with said flexible spring contact at one end thereof, said first terminal engaging said first projecting ear on said fuse carrier body member to mount said flexible spring contact thereon;

a first terminal clip secured in said fuse holder to engage said first fuse terminal and electrically connect said first terminal clip and said flexible spring contact;

a rounded shoulder formed at the end of said first projecting ear, said flexible spring contact passing over said rounded shoulder and being protected thereby from breaking when forcibly bent thereover;

a generally rectangular slot formed in said flexible spring contact in the vicinity of maximum bending near said first fuse terminal to reduce the return force exerted by said flexible spring contact when flexed;

an indicator mounted on the free end of said flexible spring contact, the portion of said flexible spring contact bearing said indicator being formed at an angle to the adjacent portion of said spring contact;

a second projecting ear formed on said fuse carrier body member;

a second resilient generally U-shaped conducting fuse terminal engaging said second projecting ear to form a fixed terminal spaced from said flexible spring contact;

a second terminal clip secured in said fuse holder to engage said second fuse terminal and electrically connect said second terminal clip and said second fuse terminal;

first and second molded ribs formed on each of said projecting ears adjacent the open end of the respective terminals to maintain the legs of said fuse terminals substantially parallel, thereby preventing the open ends of said terminals from pinching together to form undesired tapered shapes; and a fusible link extending from said flexible spring contact to said fixed terminal to hold said flexible spring contact in a flexed position and provide a conducting path from said fixed terminal to said flexible spring contact, fusing of said link in an overload situation releasing said flexible spring contact to snap into engagement with said first holder terminal to actuate an alarm and position said indicator for visual operation.

* * * * *